US010709915B2

(12) United States Patent
Palle

(10) Patent No.: US 10,709,915 B2
(45) Date of Patent: Jul. 14, 2020

(54) FULL CONE SPRAY NOZZLE FOR A LOW PRESSURE FIRE PROTECTION SYSTEM

(75) Inventor: Carsten Palle, Svendborg (DK)

(73) Assignee: VID FIRE-KILL APS, Svendborg (DK)

( * ) Notice: Subject to any disclaimer, the term of this patent is extended or adjusted under 35 U.S.C. 154(b) by 0 days.

(21) Appl. No.: 13/582,176

(22) PCT Filed: Mar. 4, 2011

(86) PCT No.: PCT/DK2011/050069
§ 371 (c)(1),
(2), (4) Date: Sep. 14, 2012

(87) PCT Pub. No.: WO2011/107106
PCT Pub. Date: Sep. 9, 2011

(65) Prior Publication Data

US 2013/0001331 A1 Jan. 3, 2013

(30) Foreign Application Priority Data

Mar. 4, 2010 (DK) ..... 2010 70086

(51) Int. Cl.
*A62C 31/00* (2006.01)
*A62C 99/00* (2010.01)
*B05B 1/34* (2006.01)

(52) U.S. Cl.
CPC ..... *A62C 31/00* (2013.01); *A62C 99/0072* (2013.01); *B05B 1/3421* (2013.01)

(58) Field of Classification Search
CPC .... A62C 99/0072; A62C 31/00; B05B 1/3421
USPC ..... 239/463, 488, 472, 587, 569; 169/46, 5, 169/16, 70; 285/263
See application file for complete search history.

(56) References Cited

U.S. PATENT DOCUMENTS

| | | | | | |
|---|---|---|---|---|---|
| 1,518,449 | A | * | 12/1924 | Plantinga | 239/472 |
| 1,882,241 | A | * | 10/1932 | Curran | 239/101 |
| 2,428,748 | A | * | 10/1947 | Barz | 239/472 |
| 2,569,081 | A | * | 9/1951 | Veach | 239/472 |
| 3,540,658 | A | * | 11/1970 | Simmons | 239/472 |
| 3,934,823 | A | | 1/1976 | Reed | |
| 4,669,667 | A | * | 6/1987 | Perkins et al. | 239/467 |
| 5,685,376 | A | | 11/1997 | Tirronen et al. | |
| 2005/0224602 | A1 | * | 10/2005 | Foubert et al. | 239/463 |

OTHER PUBLICATIONS

International Search Report for International Patent Application Publication No. WO2011/107106 A1, dated Jul. 5, 2011, pp. 1-2.

* cited by examiner

*Primary Examiner* — Chee-Chong Lee
(74) *Attorney, Agent, or Firm* — Michael Best & Friedrich LLP

(57) ABSTRACT

A low pressure water mist nozzle for active fire protection from water supplied with supply water pressures of 0.5 bar to 20 bars, characterized by having a separation wall (3) with multiple openings (4) of sizes 01 mm to 02, 5 mm in angles of 10° to 50° to the wall surfaces, which are followed by a cavity (8) having a centrally located outlet opening (6) in its end wall, which are located opposite the separation wall (3) containing multiple openings (4).

5 Claims, 1 Drawing Sheet

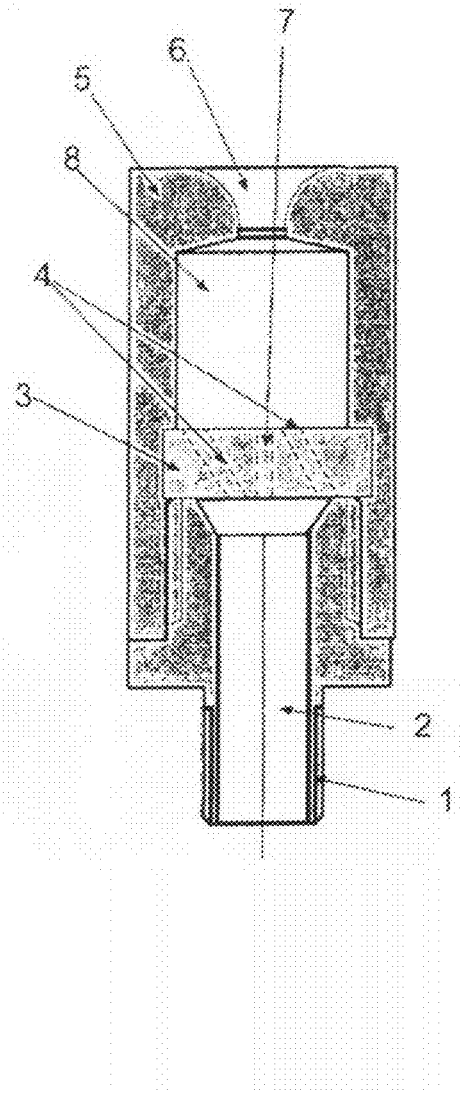
7
6
5
8
4
3
2
1

FULL CONE SPRAY NOZZLE FOR A LOW PRESSURE FIRE PROTECTION SYSTEM

CROSS-REFERENCE TO RELATED APPLICATIONS

This is the U.S. national stage entry of International Patent Application No. PCT/DK2011/050069, filed on Mar. 4, 2011, which claims priority to Danish Patent Application No. PA 2010 70086, filed on Mar. 4, 2010, the contents of all of which are herein fully incorporated by reference.

The invention relates to a low pressure water mist nozzle for active fire protection, operating with water pressures of 0.5 bar to 20 bars on the nozzle inlet port, to distribute a full cone spray of water where more than 70% of the water volume is sprayed in droplets, having droplet diameter less than 1 mm.

Full cone spray water mist nozzles for fire protection are known from high pressure water mist nozzles, which operate with water inlet pressures of 20 bars to 200 bars. The high water pressures causes inconveniencies to the pipe systems, which should withstand high water pressures, be able to withstand corrosion and cavitations from water at high pressures and flow rates. This sets high demands to the system water pipes, and water pumps, which has to be made in corrosion resistant materials, making the high pressure water mist systems complicated and price expensive. Another problem with high pressure water mist systems is that nozzles have small orifices, to limit the water flow sizes from the nozzles. The small orifice bores make high pressure water mist nozzles sensitive to clogging from impurities in water and pipe systems.

The above mentioned problem has been solved in low pressure water mist nozzles having water deflectors surfaces, on which the kinetic water energy transform water with small supply pressures into sprays consisting of small water droplets. A problem with water mist nozzles having deflectors is that the nozzles become sensitive to physical impacts, which may displace the positions of deflector surfaces to the orifices supplying water on to the deflector surfaces. Another problem with deflector water mist nozzles is to be able to transform water sprays into a fine droplet size distribution pattern, being ideal for fire protection.

The purpose of the present invention is to supply a practical solution to the above mentioned problems.

The invention differs from known low pressure water mist nozzles for active fire protection by, internally in the nozzle housing, to house a swivel plate having multiple Ø1 mm to Ø2.5 mm openings in angles of 10°-50° to the swivel plate surfaces, and a downstream swivel chamber having a central opening in the wall opposite the swivel plate.

A variant of the invention is characterized by the outlet opening of the swivel chamber having a size of ø1.5 mm to ø3 mm. This allows adjustments of water flow and water distribution angle from the nozzle.

Another variant of the invention is characterized by having a centrally located opening in the swivel plate. The opening makes the nozzle have full cone water distribution.

A third variant of the invention is characterized in that the outlet opening of the swivel chamber has an increasing cross section diameter. Hereby the spray angle of the low pressure water mist nozzle is increased.

FIG. 1 shows an example of the invention. (1) is a threaded connection to the agent supply pipe system. (2) is the agent supply inlet port. (3) is an agent swivel plate. (4) is angled openings in the agent swivel plate. (7) is a centrally located opening in the swivel plate. (5) is the nozzle housing. (8) is the agent swivel chamber and (6) is the exit opening of the swivel chamber, having an increasing cross-sectional area.

The invention performs with that the agent (water) having low supply pressures at 0.5 bar to 20 bars flows through the inlet port (2) into the nozzle housing. Here the agent flows through the angled openings (4) in the swivel plate (3) which transforms the agent jets, which rotates the agent staying in the swivel chamber (8). The friction between agent jets from the angle openings (4), and agent jet from the centre opening (7), makes the agent jet from the central opening (7) rotate. The agent flows from the swivel chamber (8) through the central exit opening (6) having an increasing cross-sectional area allowing the agent to rotate through the opening. This results in a large distribution area of the agent water mist spray.

The invention claimed is:

1. A fire protection system comprising:

at least one low pressure water mist nozzle in operable communication with a fire protection system configured to supply water through said at least one low pressure water mist nozzle at supply water pressures of 0.5 bar to 20 bars, wherein the low pressure water mist nozzle has a housing and a single separation wall (3) having both a centrally located opening (7) and multiple openings (4) of sizes 1 mm to 2.5 mm diameter, and wherein the multiple openings are at angles of 10° to 50° to the wall surfaces, the separation wall (3) is followed by a cavity (8) having a centrally located outlet opening (6) in its end wall (5), both the centrally located opening (7) and the multiple openings (4) extend between an inlet port (2) and the cavity (8), the end wall (5) is located immediately downstream of the separation wall (3) containing both the centrally located opening (7) and the multiple openings (4), wherein a surface of the end wall (5) facing the cavity (8) is conical, wherein the end wall and the housing are monolithic, wherein a thickness of the separation wall (3) is smaller than a length defined between the separation wall and the end wall (5), wherein the centrally located outlet opening (6) of the end wall (5) has a continuous nozzle surface defining an increasing cross-sectional area, and wherein the continuous nozzle surface is curved radially outwardly relative to a longitudinal axis of the nozzle, and wherein the cavity (8) is cylindrical in its entire length between the separation wall (3) and the conical end surface (5).

2. A fire protection system in accordance with claim 1, wherein the size of the centrally located outlet opening (6) having a diameter of 1.5 mm to 3 mm.

3. A fire protection system in accordance with claim 1, wherein the nozzle housing has an outer threaded connection (1) to an agent supply pipe system of the fire protection system.

4. A fire protection system comprising:

at least one low pressure water mist nozzle in operable communication with a water supply configured to supply water through said at least one low pressure water mist nozzle at supply water pressures of 0.5 bar to 20 bars, wherein the low pressure water mist nozzle has a housing and a single separation wall (3) having both a centrally located opening (7) and multiple openings (4) of sizes 1 mm to 2.5 mm diameter, and wherein the multiple openings are at angles of 10° to 50° to the wall surfaces, the separation wall (3) is followed by a cavity (8) having a centrally located outlet opening (6) in its end wall (5), both the centrally located opening (7) and the multiple openings (4) extends between an inlet port (2) and the cavity (8), the end wall is located opposite the separation wall (3) containing both the centrally located opening (7) and the multiple openings (4), wherein the at least one low pressure water mist nozzle is configured such that the separation wall is insertable into the nozzle housing through an opening opposite the end wall (5), wherein the end wall and the housing are monolithic, and wherein the centrally located outlet opening (6) of the end wall (5) has a continuous nozzle surface defining an increasing cross-sectional area, and wherein the continuous nozzle surface is curved radially outwardly relative to a longitudinal axis of the nozzle.

5. A fire protection system comprising:

at least one low pressure water mist nozzle in operable communication with a water supply configured to supply water through said at least one low pressure water mist nozzle at supply water pressures of 0.5 bar to 20 bars, wherein the low pressure water mist nozzle has a housing and a single separation wall (3) having both a centrally located opening (7) and multiple openings (4) of sizes 1 mm to 2.5 mm diameter, and wherein the multiple openings are at angles of 10° to 50° to the wall surfaces, the separation wall (3) is followed by a cavity (8) having a centrally located outlet opening (6) in its end wall (5), both the centrally located opening (7) and the multiple openings (4) extends between an inlet port (2) and the cavity (8), the end wall (5) is located immediately downstream of the separation wall (3) containing both the centrally located opening (7) and the multiple openings (4), wherein the cavity (8) has a diameter and a length defined between the separation wall and the end wall, wherein the length exceeds the diameter, wherein the end wall and the housing are monolithic, and wherein the centrally located outlet opening (6) of the end wall (5) has a continuous nozzle surface defining an increasing cross-sectional area, and wherein the continuous nozzle surface is curved radially outwardly relative to a longitudinal axis of the nozzle.

* * * * *